United States Patent [19]

Bishop et al.

[11] 4,153,050

[45] May 8, 1979

[54] PULSATILE STOCKING AND BLADDER THEREFOR

[75] Inventors: Robert C. Bishop, Los Angeles; Pradip V. Choksi, Northridge; Richard J. Forstrom, Granada Hills, all of Calif.

[73] Assignee: Alba-Waldensian, Incorporated, Valdese, N.C.

[21] Appl. No.: 820,104

[22] Filed: Jul. 29, 1977

[51] Int. Cl.[2] ..... A61H 7/00

[52] U.S. Cl. ..... 128/64; 128/24 R

[58] Field of Search ..... 128/64, 82.1, 24 R, 128/165, 403, 402, DIG. 20

[56] References Cited

U.S. PATENT DOCUMENTS

| | | | |
|---|---|---|---|
| 2,694,395 | 11/1954 | Brown | 128/38 |
| 2,747,570 | 5/1956 | Jobst | 128/60 |
| 2,762,366 | 9/1956 | Huxley et al. | 128/DIG. 20 |
| 3,083,708 | 4/1963 | Gottfried | 128/39 |
| 3,189,919 | 9/1971 | Chase | 2/16 |
| 3,605,737 | 8/1976 | Berman | 128/132 |
| 3,975,929 | 6/1976 | Fregeolle | 66/172 E |
| 3,983,870 | 1/1976 | Herbert et al. | 128/165 |
| 4,005,494 | 2/1977 | Bura | 2/239 |
| 4,054,129 | 10/1977 | Byars et al. | 128/24 R |

FOREIGN PATENT DOCUMENTS

| | | | |
|---|---|---|---|
| 836549 | 4/1952 | Fed. Rep. of Germany | 128/64 |

*Primary Examiner*—Lawrence W. Trapp
*Attorney, Agent, or Firm*—Larry N. Barger

[57] ABSTRACT

A device for applying intermittent compression to a body member, such as a leg, of a patient is disclosed. This device has a highly elastic stocking of the antiembolism type with an inelastic external panel secured to a portion of the stocking's circumference to provide a bladder cavity and restrict circumferential stretching of only a portion of the stocking. The inelastic panel has an openable structure, and internal bladder retaining pockets. An inflatable bladder includes an inner shaping panel causing the bladder to more readily conform to the shin area of the leg.

21 Claims, 6 Drawing Figures

PULSATILE STOCKING AND BLADDER THEREFOR

BACKGROUND OF THE INVENTION

It is well-known that patients in hospitals often develop deep vein thrombosis or blood clots in the leg veins over extended periods of hospital stay. This is particularly prevalent in elderly weak patients and those undergoing major surgery. It has been known that this condition can be controlled or alleviated by applying intermittent pressure to the patient's legs to assist in blood circulation. Many devices have been proposed, such as compression boots and other inflation tube devices. The prior boots had the disadvantage of being very cumbersome and substantially restricting the movement of the patient. To overcome this, it has been proposed by others to use an elastic stocking with an internal panel creating a pocket within the stocking for receiving an inflatable pulsating bladder. Such a device is schematically shown in cross-section by FIG. 1, wherein dotted lines are used to show both the stretchable outer stocking layer and the inner panel.

In the prior art pulsatile elastic stocking of FIG. 1, the stocking had to be sufficiently stretchable for easy donning and yet be sufficiently inelastic at an upper limit to provide sufficient compressive forces against the leg when the bladder was inflated. These competing functions made it difficult to provide the precise stretch-ability in the elastic stocking such that a stocking could fit a substantial range of patient leg sizes and shapes.

SUMMARY OF THE INVENTION

This invention provides an improvement to the elastic pulsatile stocking shown in the prior art of FIG. 1. The improvement over the prior art is shown schematically in FIG. 2 where a highly elastic stocking has a substantially inelastic outer panel that encases only a portion of the stocking's circumference. Thus, a bladder cavity is defined between the inelastic outer panel and the inner highly elastic stocking, and this inelastic panel restricts circumferential stretching of a stocking portion within the inelastic panel, but does not restrict stretching of remaining portions of the stocking. Preferably the inelastic panel has a slide fastener for temporarily opening it to insert an inflatable bladder, and provide unrestricted circumferential stretching of the stocking during donning and removing from a patient's leg. The inelastic panel has internal pockets for retaining the bladder in proper position. The bladder also has an internal shape defining panel to cause an inflated bladder to more readily conform to the shape of the leg'shin area.

DETAILED DESCRIPTION

Figure 1:
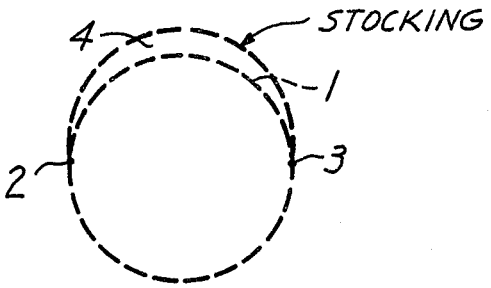
FIG. 1 PRIOR ART
FIG. 1 is a schematic sectional view of a pulsatile elastic stocking proposed by others.

In the pulsatile elastic stocking proposed by others, shown in FIG. 1, an outer elastic stocking has an inner panel 1 secured to the stocking at approximately diametrically opposed seam areas 2 and 3. This creates a bladder pocket 4. Since the stocking is outside the bladder, it has to perform two competing functions. First it must be stretchable enough for easy donning and removal, and yet be sufficiently unstretchable to produce an inward compressive force against a bladder (not shown) to exert a pressure against a patient's leg. Thus, the elastic stocking of FIG. 1 has very limited elasticity in a circumferential direction. For instance, such stocking generally had an upper limit of elongation in a circumferential direction of less than 150%. This limited elasticity rendered the stocking usable over a very limited range of leg sizes and shapes.

This invention makes an improvement in the stocking shown in FIG. 1, by providing a highly elastic inner tubular member, such as a stocking, having the capability of elongating in a circumferential direction in an amount of at least 150%. The highly elastic stocking of a porous air breathable material is capable of elongation in a circumferential direction of from 150% to 500%. A stocking capable of elongating a circumferential direction of approximately 300% has been shown to work exceedingly well for present invention. The highly elastic stocking of this invention also had the capability of substantial elongation in a longitudinal direction. For instance, the pulsatile stocking of this invention can stretch from 150% to 600% in the longitudinal direction, and a stocking capable of 400% longitudinal stretch words exceptionally well. By contrast, the stocking of the prior art FIG. 1 design, stretched only approximately 110% in the longitudinal direction because of the compressive demands on such stocking for holding the inflatable bladder.

Figure 2:
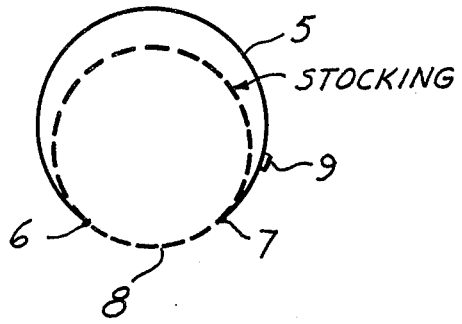
FIG. 2 is an improvement to the prior art stocking of FIG. 1, in which an inelastic outer panel is shown.

The highly elastic stocking of FIG. 2 is preferably of the anti-embolism type used in hospitals for static compression of the patient's leg. Such stockings are marketed under the trademark CARE stocking. Such stockings are highly elastic and firmly grip the leg. They usually have a different knit construction in the ankle area to provide a tighter grip around the ankel then around the calf section to prevent pooling of blood in the ankle area. U.S. Pat. No. 3,975,929 and 3,983,870 describe typical anti-embolism stockings.

Combined with the highly elastic stocking of FIG. 2 is an outer inelastic panel 5. This inelastic panel 5 encases a major portion of the elastic stocking and is secured to such stocking at longitudinal seams 6 and 7. Thus, the stocking encased within inelastic panel 5 has restricted stretchability after it is on the patient, because of the inelasticity of panel 5. However, an unencased portion 8 representing less than ½ of the stocking's unstretched circumference is free to circumferentially expand with patient leg movement to provide increased comfort to the patient. It has been found that the stocking and inelastic panel work very well when a portion of the circumference in the range of 15% of the unstretched stocking's circumference is not encased within the panel. Preferably, the inelastic panel 5 has an openable seam shown schematically as numeral 9 in FIG. 2.

Figure 3:
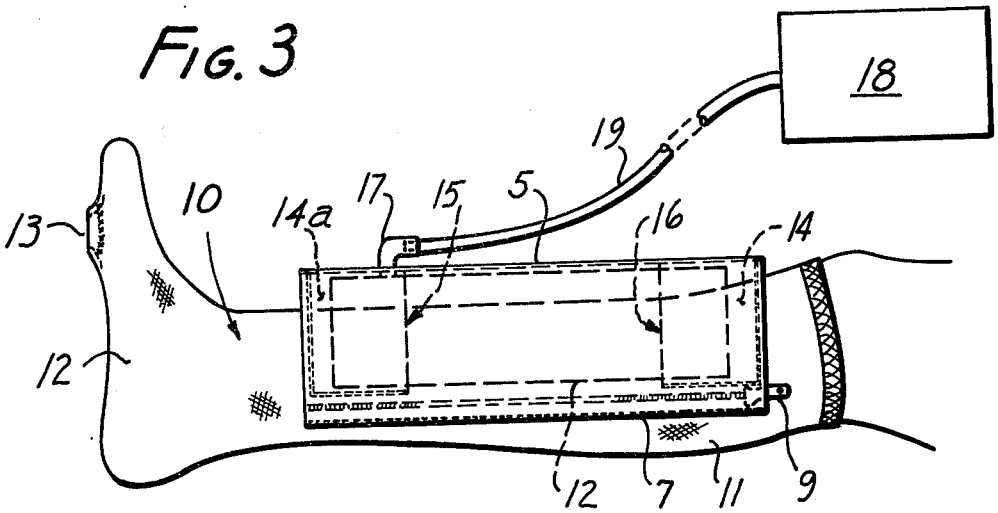
FIG. 3 is a side elevational view of the pulsatile elastic stocking of this invention with an internal bladder connected to a pulsating pressure source.

FIG. 3 shows the highly elastic stocking 10 which has a calf portion 11 and a foot portion 12. If desired, a toe inspection hole 13 can be provided in the stocking. Fitting over an upper portion of the stocking is inelastic panel 5 which is preferably of a substantially non-stretchable cloth. Inelastic panel 5 is secured to an outer surface of stocking 10 by a stitched seam 7. A bladder 12 fits within a bladder cavity inelastic panel 5 and highly elastic stocking 10. Bladder 12 is held in position by a pair of pockets 14 and 14*a* at opposite ends of panel 5. These pockets are formed by separate small rectangular fabric segments stitched along three sides to panel 5. Sides 15 and 16 remained unstitched to provide an opening for bladder 12. Alternatively, the bladder retaining pockets could have end portions of panel 5 that are longitudinally folded inwardly and then these end portions sewn to remaining portions of panel 5 to form pockets. Such construction would eliminate the need for separately cutting rectangular pieces. If desired, the pockets could be sewn into the stocking 10 itself rather than on the panel 5.

It is preferable to provide an opening means such as a slide fastener 9. A pressure contact fastening means, such as snaps, on hook and loop fasteners marketed under the name VELCRO could also be used. Such opening means provide easy access for insertion and removal of the bladder, and also provides less restriction of stocking stretching during donning and removal from a patient's leg.

Once the device has been assembled on the patient as shown in FIG. 3, a bladder port 17 is connected to a pulsating air pressure source 18 by means of a tube 19.

Figure 4:
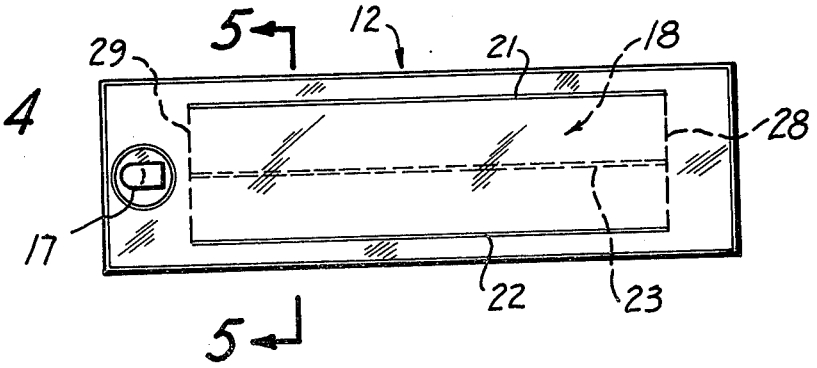
FIG. 4 is a top plan view of an inflatable bladder for this pulsatile elastic stocking.
Figure 5:
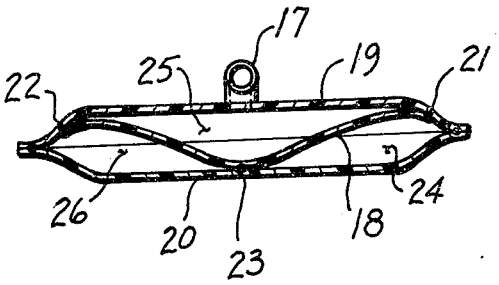
FIG. 5 is a sectional view taken along line 5—5 of FIG. 4 showing the bladder in a nearly deflated condition.
Figure 6:
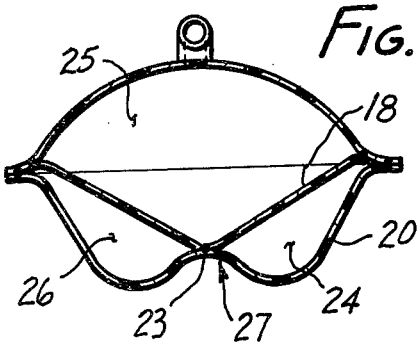
FIG. 6 is a sectional view similar to that of FIG. 5, but showing the bladder in inflated condition.

FIGS. 4, 5, and 6 show the construction of the internal bladder 12 which is formed by two superimposed thermoplastic panels heat sealed about their periphery. A port 17 is sealed to an upper panel to provide flow communication with an interior of the bladder.

An important feature of the bladder configuration is an interior shape defining panel 18 encased between upper panel 19 and lower panel 20. As shown in its deflated condition, panel 18 is sealed to upper panel 19 at 21 and 22 near the peripheral seals of the upper and lower panels. The center section of shape defining panel 18 is heat sealed to a central section of lower panel 20 at 23. Thus, a central area of the bladder has three compartments 24, 25, and 26.

When the bladder is inflated, shape retaining panel causes a central portion of the bladder to assume the cross-sectional shape shown in FIG. 6. The heat seal at 23 causes the lower panel of the bladder to be pulled into a recessed configuration shown at 27. Thus, the bladder more closely follows the contour of the shin area of the patient's leg. The chambers 24 and 26 provide for even pressure on opposite sides of the shin. This configuration also helps prevent shifting of the bladder to a side of the leg. So the bladder can inflate as shown in FIG. 6, shape retaining panel 18 is unsealed to either the top or bottom panels at its end 28 and 29. Therefore, all of the chambers 24, 25, and 26 are interconnected and maintained at a common pressure through an opening or vent across the shape retaining panel. It has been found that the bladder works very well when formed of a thermoplastic material, such as polyvinylchloride.

In the foregoing drawings and specification, a specific example has been used to describe the invention. However, it is understood by those skilled in the art that certain modifications can be made to this example without departing from the spirit and scope of the invention.

We claim:

1. A device for use in applying pulsatile compression to a patient comprising: a porous air breathable circumferentially elastic tube; and a panel secured at circumferentially spaced locations to an exterior of the tube to provide a bladder receiving cavity between the panel and the tube, said panel being substantially less elastic than the tube in a circumferential direction to restrict the circumferential stretching of only a portion of the device.

2. The device as set forth in claim 1, wherein the tube is capable of circumferential elongation at least 150%.

3. The device as set forth in claim 1, wherein the tube is at least a portion of a medical leg compession stocking.

4. The device as set forth in claim 3, wherein the stocking is of an anti-embolism type stocking having an ankle portion constructed to squeeze a patient's leg tighter than a calf portion of the stocking.

5. The device as set forth in claim 1, wherein the device includes bladder positioning means to prevent shifting of a bladder when positioned within said bladder receiving cavity.

6. The device as set forth in claim 5, wherein the bladder positioning means includes a pair of longitudinally spaced pockets secured to an innner surface of the panel.

7. The device as set forth in claim 1, wherein the panel has opening mens for temporarily disconnecting at least a portion of the panel from the tube during donning and removal from a patient.

8. The device as set forth in claim 7, wherein the opening means is selected from the group consisting of a slide fastener and a contact pressure fastener.

9. The device as set forth in claim 1, wherein the tube has less than ½ of its unstretched circumference that is not confined within the panel.

10. The device as set forth in claim 9, wherein the tube has between 15% and 45% of its circumference that is not encased by the panel, and thus does not have its circumferential stretch restricted thereby.

11. A system for applying pulsatile compression to a patient comprising: a porous air breathable circumferentially elastic tube; a panel secured at circumferentially spaced locations to an exterior of the tube to provide a bladder receiving cavity between the panel and tube, said panel being substantially less elastic than the tube in a circumferential direction to restrict the circumferential stretchability of only a portion of the device; an inflatable bladder within the bladder receiving cavity; and pulsating means to sequentially inflate and deflate the bladder.

12. The system as set forth in claim 11, wherein the panel has a pair of opposed pockets which prevent shifting of the bladder within the bladder receiving cavity.

13. The system as set forth in claim 11, wherein the tube is of a material capable of circumferential elongation of at least 150% but has more than ½ of its unstretched circumference restricted from such elongation by the inelastic panel.

14. The system as set forth in claim 13, wherein the tube is of a material capable of circumferential elongation of from 150% to 400%.

15. The system as set forth in claim 11, wherein the tube is of a material capable of longitudinal elongation of at least 150% for ease of donning.

16. The system as set forth in claim 15, wherein the tube is of a material capable of longitudinal elongation within the range of 150% to 600%.

17. The system as set forth in claim 11, wherein the panel has an openable section with an opening means.

18. A system for applying pulsatile compression to a patient comprising: A highly elastic porous air breathable tube; a substantially inelastic panel secured at circumferentially spaced locations to an exterior of the tube to provide a bladder receiving cavity between the panel and the tube and restrict the circumferential stretchability of only a portion of the device; an inflatable bladder within the bladder receiving cavity; said bladder including upper and lower panels secured to each other about their peripheries to define a chamber therein; an internal shape restricting panel secured between the upper and lower panels to control the shape of the bladder during inflation; and pulsating means to sequentially inflate and deflate the bladder.

19. The system as set forth in claim 18, wherein the internal shape defining panel is secured along a longitudinal central portion of the lower panel, and adjacent longitudinal edge portions of the upper panel, whereby a shin cavity is formed in the lower panel upon inflation of the bladder.

20. The system as set forth in claim 19, wherein the bladder has vent means across the shape retaining panel, so upper and lower chambers of the bladder defined by the shape retaining panel are maintained at equal pressures.

21. A device for applying pulsatile compression to a patient by means of an inflatable bladder within a cavity of a body support system, wherein the improvement comprises: a bladder having upper and lower panels secured to each other about their peripheries, and an inner shape defining panel within the bladder to control the shape of the bladder into a more anatomical shape during inflation.

* * * * *